US011267630B2

(12) United States Patent
Yajima

(10) Patent No.: US 11,267,630 B2
(45) Date of Patent: Mar. 8, 2022

(54) PACKAGING BAG

(71) Applicant: TOPPAN PRINTING CO., LTD., Tokyo (JP)

(72) Inventor: Shunsuke Yajima, Tokyo (JP)

(73) Assignee: TOPPAN PRINTING CO., LTD., Tokyo (JP)

( * ) Notice: Subject to any disclaimer, the term of this patent is extended or adjusted under 35 U.S.C. 154(b) by 0 days.

(21) Appl. No.: 16/714,051

(22) Filed: Dec. 13, 2019

(65) Prior Publication Data

US 2020/0115126 A1 Apr. 16, 2020

Related U.S. Application Data

(63) Continuation of application No. PCT/JP2018/022437, filed on Jun. 12, 2018.

(30) Foreign Application Priority Data

Jun. 16, 2017 (JP) ..... JP2017-118741
Jun. 16, 2017 (JP) ..... JP2017-118742
Jun. 16, 2017 (JP) ..... JP2017-118743

(51) Int. Cl.
*B65D 33/00* (2006.01)
*B65D 75/58* (2006.01)
(Continued)

(52) U.S. Cl.
CPC ..... *B65D 75/5827* (2013.01); *B65D 31/02* (2013.01); *B65D 75/322* (2013.01)

(58) Field of Classification Search
CPC ... B65D 75/5827; B65D 75/322; B65D 31/02
(Continued)

(56) References Cited

U.S. PATENT DOCUMENTS 3,399,760 A * 9/1968 Hechler, IV ..... B65D 75/585 383/207
5,934,809 A * 8/1999 Marbler ..... B65D 75/585 229/87.05
(Continued)

FOREIGN PATENT DOCUMENTS

CN 102947195 A 2/2013
JP 2002-002790 A 1/2002
(Continued)

OTHER PUBLICATIONS

International Searching Authority, "International Search Report," issued in connection with the International Patent Application No. PCT/JP2018/022437, dated Jul. 31, 2018.
(Continued)

*Primary Examiner* — Peter N Helvey
(74) *Attorney, Agent, or Firm* — Foley & Lardner LLP

(57) ABSTRACT

An object is to provide a packaging bag that can be suitably used with provision of a score line. The packaging bag has a rectangular shape formed by overlapping film sheets and sealing at least three edges thereof to form a container part. In the packaging bag, a score line, in which the strength of the film is reduced, is formed on the container part away from the seal part in plan view. The packaging bag further includes a notch formed in at least one edge among the three edges and serving as a start point for breaking the film when the container part is to be opened. The score line is formed along a straight line extending from the notch to an edge facing the edge in which the notch is formed, in a direction perpendicular to the edge in which the notch is formed.

12 Claims, 10 Drawing Sheets

(51) Int. Cl.
*B65D 30/08* (2006.01)
*B65D 75/32* (2006.01)

(58) Field of Classification Search
USPC ..... 383/207
See application file for complete search history.

(56) References Cited

U.S. PATENT DOCUMENTS 6,126,317 A * 10/2000 Anderson ..... B65D 75/5827 229/87.05
8,251,217 B2 * 8/2012 Hemmerlin ..... B65D 75/5805 206/532
8,740,458 B2 * 6/2014 Edwards ..... B65B 51/303 383/207
9,370,463 B2 * 6/2016 Krumme ..... A61J 1/00
9,493,285 B2 * 11/2016 Krumme ..... B65D 75/5833
2003/0089625 A1 * 5/2003 Moodie ..... B65D 75/585 206/204
2003/0152300 A1 * 8/2003 Tu ..... B65D 75/5811 383/207
2006/0269174 A1 * 11/2006 Huffer ..... B65D 75/5844 383/207
2007/0274615 A1 11/2007 Deniaud et al.
2008/0253701 A1 * 10/2008 Wilson ..... B65D 75/5805 383/207
2010/0142863 A1 * 6/2010 Bunge ..... B65D 75/58 383/207
2010/0177993 A1 * 7/2010 Chen ..... B65D 75/5805 383/207
2011/0064338 A1 * 3/2011 Surdziel ..... B65D 75/008 383/207
2012/0213456 A1 * 8/2012 Sugiyama ..... B65D 75/5805 383/207
2013/0199958 A1 8/2013 Reichardt et al.
2013/0301960 A1 * 11/2013 Krumme ..... A61J 1/00 383/207
2014/0086514 A1 * 3/2014 Yamada ..... B65D 75/5805 383/209
2015/0055895 A1 * 2/2015 Kishi ..... B65D 77/38 383/207
2015/0353237 A1 * 12/2015 Haedt ..... B65D 75/5805 383/207
2016/0137377 A1 * 5/2016 Tracy ..... B65D 75/008 222/566

FOREIGN PATENT DOCUMENTS

JP 2014-166888 A 9/2014
JP 2015-231844 A 12/2015
WO WO-2015/105101 A1 7/2015

OTHER PUBLICATIONS

International Searching Authority, "Written Opinion," issued in connection with the International Patent Application No. PCT/JP2018/022437, dated Jul. 31, 2018.
Chinese Office Action dated May 28, 2021, in Chinese Application No. 201880040001.5.

* cited by examiner

102

103

201

202

301

302

303

901

902

903

904

905

PACKAGING BAG

CROSS-REFERENCE TO RELATED PATENT APPLICATIONS

This application is a continuation application filed under 35 U.S.C. § 111(a) claiming the benefit under 35 U.S.C. §§ 120 and 365(c) of International Patent Application No. PCT/JP2018/022437, filed on Jun. 12, 2018, which is based upon and claims the benefit of priority to Japanese Patent Application No. 2017-118741, filed on Jun. 16, 2017; Japanese Patent Application No. 2017-118742, filed on Jun. 16, 2017; and Japanese Patent Application No. 2017-118743, filed on Jun. 16, 2017; the disclosures of which are all incorporated herein by reference in their entireties.

TECHNICAL FIELD

The present invention relates to a packaging bag.

BACKGROUND ART

Three-sided seal bags or four-sided seal bags are well known. The three-sided seal bags are formed by folding one laminated rectangular film in half and sealing the overlapped edges with each other to provide a container part. The four-sided seal bags are formed by overlapping a pair of laminated rectangular films with each other and sealing (heat-sealing) the edges to provide a container part.

PTL 1 discloses a rectangular packaging bag (four-sided seal bag) in which score lines (opening lines) where strength is reduced are formed on the front and back laminated films. The score lines are formed such as by half-cutting so as to respectively extend parallel to two adjacent edges among the four edges. This packaging bag can package sheet-shaped contents, such as a medical tape or a patch, for transdermal administration of medication.

The user of this packaging bag firstly breaks the laminated films from a start notch formed at an edge of the packaging bag along a score line until the break reaches the opposite end. Then, the user of the packaging bag breaks the laminated films from a start notch formed at another edge of the packaging bag along another score line until the break reaches the opposite end. As a result, an opening is formed in the packaging bag, being defined by the break lines which are formed along the two score lines. Since a large opening is provided, the user of the packaging bag can easily remove the contents from the opening.

[Citation List] [Patent Literature] PTL 1: WO 2015/105101-A1

SUMMARY OF THE INVENTION

Technical Problem

Such packaging bags are used for various purposes. However, no sufficient studies have been made for suitably usable shapes of the score lines.

The present invention has been made in light of such an issue and aims to provide a packaging bag which is provided with a score line that can be suitably used.

Solution to Problem

To solve the issue set forth above, an aspect of the present invention is a packaging bag having a rectangular shape formed by overlapping film sheets and sealing at least three edges thereof to form a container part. In the packaging bag, a score line, in which the strength of the films is reduced, is formed on the container part away from the seal part in plan view.

Advantageous Effects of the Invention

The present invention can provide a packaging bag that can be suitably used with provision of a score line.

DETAILED DESCRIPTION

Figure 1:
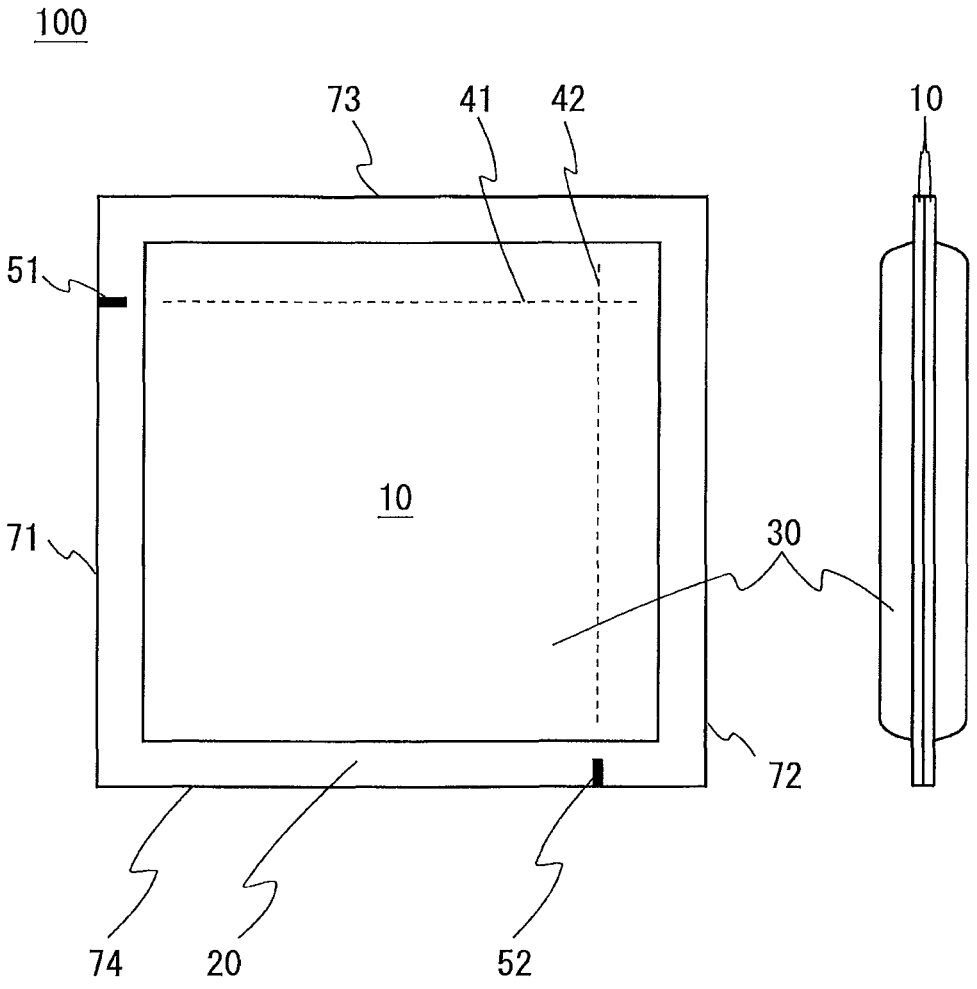
FIG. 1 is a set of diagrams, i.e., a plan view and a side view, illustrating a packaging bag according to a first embodiment of the present invention.

With reference to the accompanying Figures, a description will now be given of representative embodiments according to the present invention. The present invention is not limited to the following representative embodiments, and appropriate modifications can be made without departing from the spirit of the present invention. The representative embodiments described below are merely examples of the present invention, and the design thereof could be appropriately changed by one skilled in the art. Here, the drawings are schematic, and the relationship between thickness and plane size, the ratio of the thickness of each layer, etc., may be different from actual ones. The embodiments described below are merely examples of the configurations for embodying the technical idea of the present invention, and the technical idea of the present invention should not limit the materials, shapes, structures, and the like of the components to those described below. The technical idea of the present invention can be modified in various ways within the technical scope specified by the claims.

The same constituent elements are denoted by the same reference numerals unless there is a reason for the sake of convenience, and redundant description is omitted. In the drawings referred to in the following description, for clarity, characteristic parts are enlarged, and thus the components are not shown to scale. It is, however, clear that one or more embodiments can be implemented without such details. In addition, known structures and devices may be schematically represented for simplicity.

First Embodiment

FIG. 1 is a set of diagrams, i.e., a plan view and a side view, illustrating a packaging bag 100 according to a first embodiment of the present invention. The packaging bag 100 is formed of two rectangular films 10 overlapped with each other, and includes a seal part 20 and a container part 30. The seal part 20 is formed by sealing four edges 71 to 74 of the overlapped films 10. The container part 30 is a portion surrounded by the seal part 20. The packaging bag 100 further includes a first score line 41 and a second score line 42, and a first notch 51 and a second notch 52. The first and second score lines 41 and 42 are formed at least on the container part 30 to reduce the strength of the films 10. The first and second notches 51 and 52 are respectively formed on any two of the edges 71 to 74 to serve as start points for breaking the films 10 when the container part 30 is to be opened.

In the following description, the edge in which the first notch 51 is formed is referred to as a first edge 71, the edge which faces the first edge 71 is referred to as a second edge 72, and, of the edges adjacent to the first edge 71, the edge near the first notch 51 is referred to as a third edge 73, and the edge which faces the third edge 73 is referred to as a fourth edge 74.

(Films)

The films 10 each have a rectangular shape. By sealing the edges 71 to 74 of the films 10, a packaging bag 100 having a container part 30 can be provided. As the films 10, multilayer films may be suitably used. To seal the edges 71 to 74 of the films such as by heat sealing, the multilayer films may each include two or more layers including a sealant layer as an innermost layer. For example, materials that can be used for the layer of each film 10 include polyethylene terephthalate (PET), aluminum (AL), cellophane, polyethylene (PE), transparent deposition PET, and low adsorption sealant (PET having heat-sealing properties, cyclic polyolefin, EVOH sealant or the like). In the case of a multilayer film, these materials may be combined as appropriate.

(Notches)

The first and second notches 51 and 52 are formed in the edges 71 to 74 of the packaging bag 100. When opening the container part 30, the user of the packaging bag 100 can break the films 10 using the first and second notches 51 and 52 as start points. As shown in FIG. 1, the packaging bag 100 includes the first notch 51 formed in the first edge 71, and the second notch 52 formed in the fourth edge 74. The first and second notches 51 and 52 are formed by cutting the seal part 20 in a line over a predetermined length toward corresponding ones of the facing edges 71 to 74. As long as the first and second notches 51 and 52 can serve as start points for breaking the films 10, the shape of them is not limited to a linear shape but may be a triangular or pentagonal shape, or other shapes.

(Score Lines)

The first and second score lines 41 and 42 are portions in which the strength of the films 10 is reduced in a line. The first score line 41 can guide the break line starting from the first notch 51 to the vicinity of the seal part 20 where there is the second edge 72 facing the first edge 71. The second score line 42 can guide the break line started from the second notch 52 to the vicinity of the seal part 20 where there is the third edge 73 facing the fourth edge 74.

In the packaging bag 100, the first and second score lines 41 and 42 are formed on both of the two films 10 so that those in one film 10 respectively align with those in the other film 10 in plan view when the films 10 are formed into the packaging bag 100. However, the first and second score lines 41 and 42 may be formed on either one of the two films 10.

As shown in FIG. 1, the first and second score lines 41 and 42 are formed on the container part 30 away from the seal part 20 in plan view. The first and second score lines 41 and 42 are formed on phantom straight lines (not shown) respectively extending from the first and second notches 51 and 52 in directions perpendicular to the first and fourth edges 71 and 74.

Figure 2:
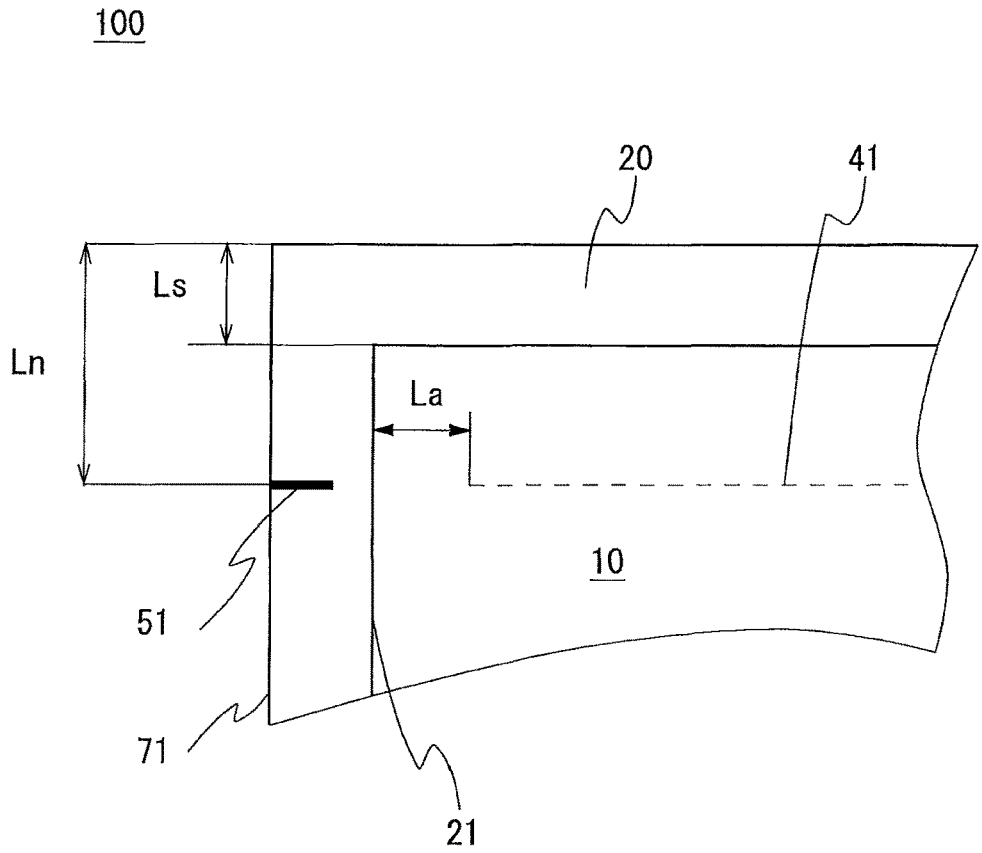
FIG. 2 is a diagram illustrating the position for forming a score line.

FIG. 2 is an enlarged view of the packaging bag 100 illustrating the position for forming a score line, taking the first score line 41 as an example. There is a distance La between an end of the first score line 41 and an inner edge 21 of the seal part. The distance La is preferred to be larger. Specifically, the distance La may preferably be 1 mm or more. When the distance La is 1 mm or more, the first score line 41 should not be formed near the inner edge 21 of the seal part. Accordingly, stress is prevented from concentrating on the film 10 near the inner edge 21 of the seal part. As a result, the occurrence of microcracks is minimized in the film 10 near the inner edge 21 of the seal part. In particular, when the film 10 is a multilayer film including an aluminum layer that easily suffers microcracks, loss of barrier performance, which would otherwise occur in the packaging bag 100 due to the occurrence of microcracks in the aluminum layer, can be suitably prevented.

The first and second score lines 41 and 42 can be obtained by forming intermittent linear cuts (half-cuts) in each film 10. When the film 10 is a laminated film, the first and second score lines 41 and 42 may be formed by forming cuts only through the outermost layer of the laminated film. A known method, such as a method using a Thomson blade or a razor blade, or a method using a carbon dioxide laser, may be used for forming the first and second score lines 41 and 42.

(Modifications)

Figure 3:
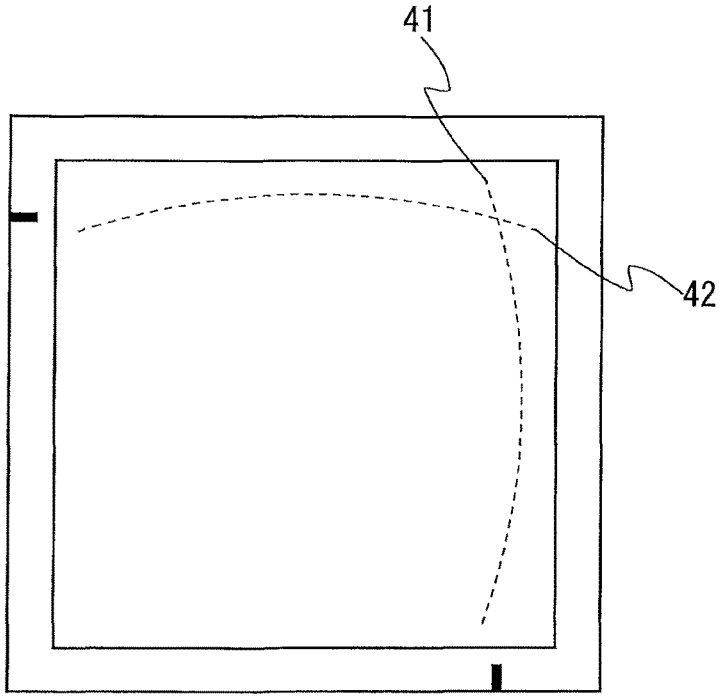
FIG. 3 is a plan view illustrating a packaging bag according to a modification of the present invention.

The first and second score lines 41 and 42 may be curves instead of straight lines. FIG. 3 shows a packaging bag 101 according to a modification in which the first and second score lines 41 and 42 are formed into curves.

Figure 4:
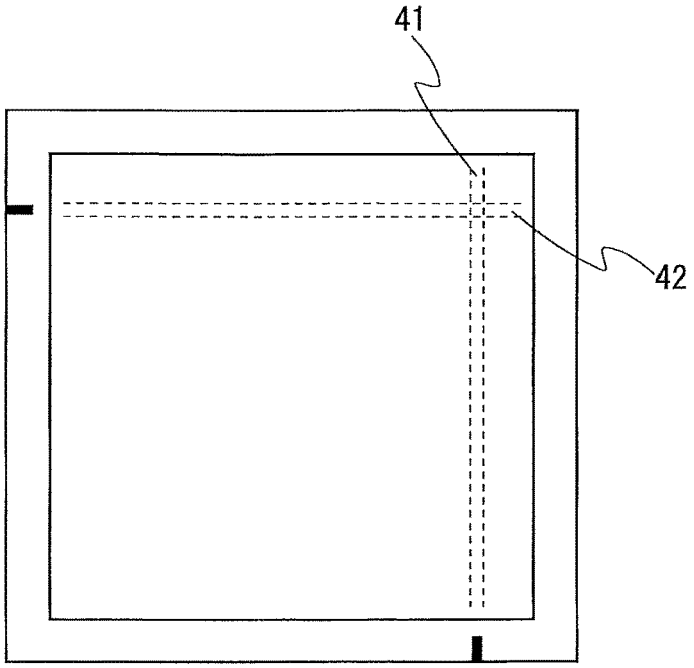
FIG. 4 is a plan view illustrating a packaging bag according to a modification of the present invention.
Figure 5:
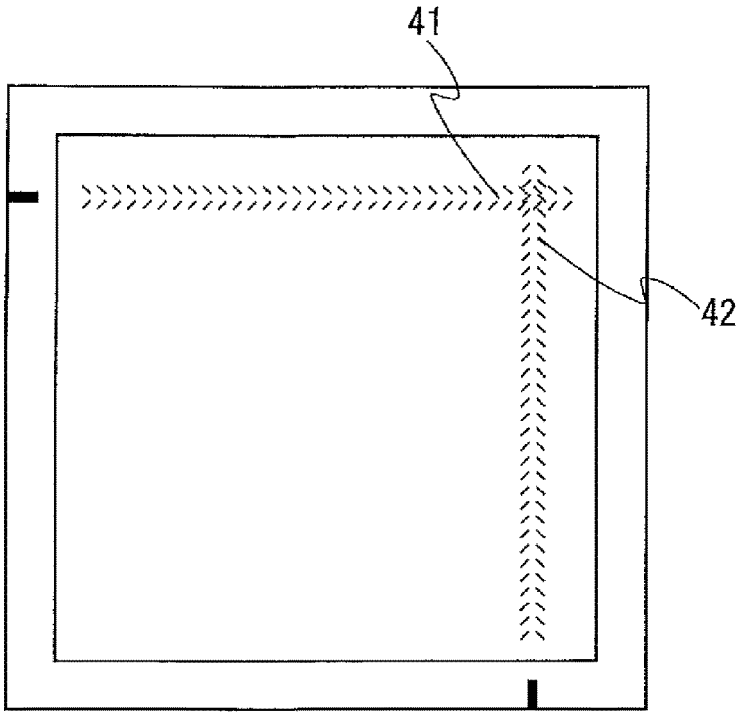
FIG. 5 is a plan view illustrating a packaging bag according to a modification of the present invention.

As long as the first and second score lines 41 and 42 can reduce the strength of the films 10 in a line, the shape of them is not limited to perforations which are structured by intermittent cuts. FIG. 4 shows a packaging bag 102 according to a modification in which the first and second score lines 41 and 42 are each formed of two parallel straight lines each of which is formed of intermittent linear half-cuts. FIG. 5 shows a packaging bag 103 according to a modification in which the first and second score lines 41 and 42 are each formed as perforations in the shape of the kanji character for eight. Specifically, in the perforations, pairs of fine cuts, each pair forming the kanji character for eight (pairs each structured by non-parallel linear cuts facing each other), are arranged in a line. Besides these shapes, the first and second score lines 41 and 42 may each be a straight line or multiple parallel straight lines, or may have other shapes.

The packaging bag 100 is a four-sided seal bag. However, as long as the packaging bag is a rectangular packaging bag having a container part that is formed by sealing at least three edges, the packaging bag is not limited to a four-sided seal bag. For example, the packaging bag may be a three-sided seal bag formed by folding one laminated rectangular film in half and sealing the overlapped edges with each other. Alternatively, the packaging bag may be a four-sided seal bag formed by folding one laminated rectangular film in half to provide four edges.

In the packaging bag 100, one first score line 41 and one second score line 42 are formed. However, either one of them may be formed.

Second Embodiment

Figure 6:
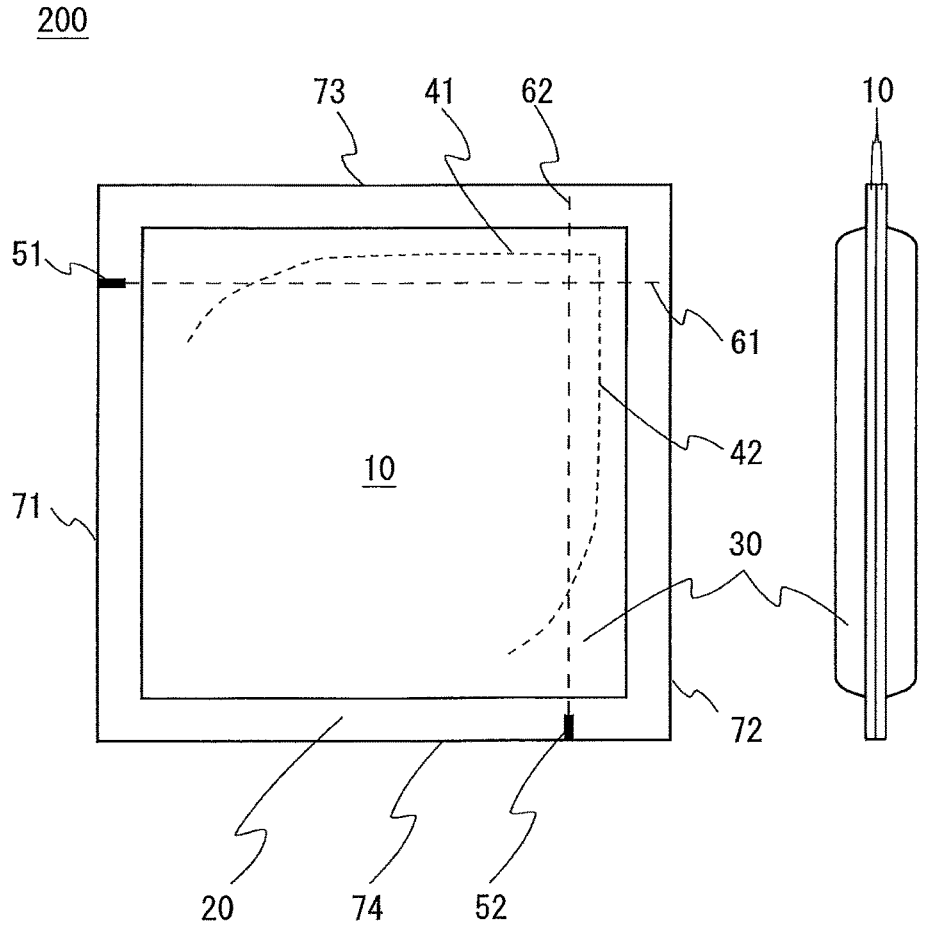
FIG. 6 is a set of diagrams, i.e., a plan view and a side view, illustrating a packaging bag according to a second embodiment of the present invention.

FIG. 6 is a set of diagrams, i.e., a plan view and a side view, illustrating a packaging bag 200 according to a second embodiment of the present invention. The packaging bag 200 is formed of two rectangular films 10 overlapped with each other, and includes a seal part 20 and a container part 30. The seal part 20 is formed by sealing four edges 71 to 74 of the films 10. The container part 30 is a portion surrounded by the seal part 20. The packaging bag 200 further includes a first score line 41 and a second score line 42, and a first notch 51 and a second notch 52. The first and second score lines 41 and 42 are formed at least on the container part 30 to reduce the strength of the films 10. The first and second notches 51 and 52 are respectively formed on any two of the edges 71 to 74 to serve as start points for breaking the films 10 when the container part 30 is to be opened. The packaging bat 200 is different from the packaging bag 100 in the shape of the score lines.

(Score Lines)

The first and second score lines 41 and 42 are portions in which the strength of the films 10 is reduced in a line. The first score line 41 can prevent the break line from reaching the third edge 73 which is an edge near the first notch 51 among the edges adjacent to the first edge 71. The second score line 42 can prevent the break line from reaching the second edge 72 which is an edge near the second notch 52 among the edges adjacent to the fourth edge 74.

In the packaging bag 200, the first and second score lines 41 and 42 are formed on both of the two films 10 so that those in one film 10 respectively align with those in the other film 10 in plan view when the films 10 are formed into the packaging bag 200. However, the first and second score lines 41 and 42 may be formed on either one of the two films 10.

As shown in FIG. 6, the first and second score lines 41 and 42 are formed on the container part 30 away from the seal part 20 in plan view. The first score line 41 is formed so as to pass through an area sandwiched between a phantom first straight line 61 and the third edge 73. The phantom first straight line 61 extends from the first notch 51 to the second edge 72 in a direction perpendicular to the first edge 71. The third edge 73 is an edge near the first notch 51 among the edges adjacent to the first edge 71. More specifically, the first score line 41 is structured by a first curve and a second curve. The first curve extends from the vicinity of the first edge 71 toward the second edge 72 so as to approach the third edge 73 and intersects the phantom first straight line 61 extending from the first notch 51 to the second edge 72 in a direction perpendicular to the first edge 71. The second curve extends from a second edge 72 side end of the first curve toward the second edge 72 so as to be substantially parallel to the third edge 73.

The second score line 42 is formed so as to pass through an area sandwiched between a phantom second straight line 62 and the second edge 72. The second phantom straight line 62 extends from the second notch 52 to the third edge 73 in a direction perpendicular to the third edge 73. More specifically, the second score line 42 is structured by a first curve and a second curve. The first curve extends from the vicinity of the fourth edge 74 toward the third edge 73 so as to approach the second edge 72 and intersects the phantom second straight line 62 extending from the second notch 52 to the third edge 73 in a direction perpendicular to the third edge 73. The second curve extends from a third edge 73 end of the first curve toward the third edge 73 so as to be substantially parallel to the second edge 72.

Figure 7:
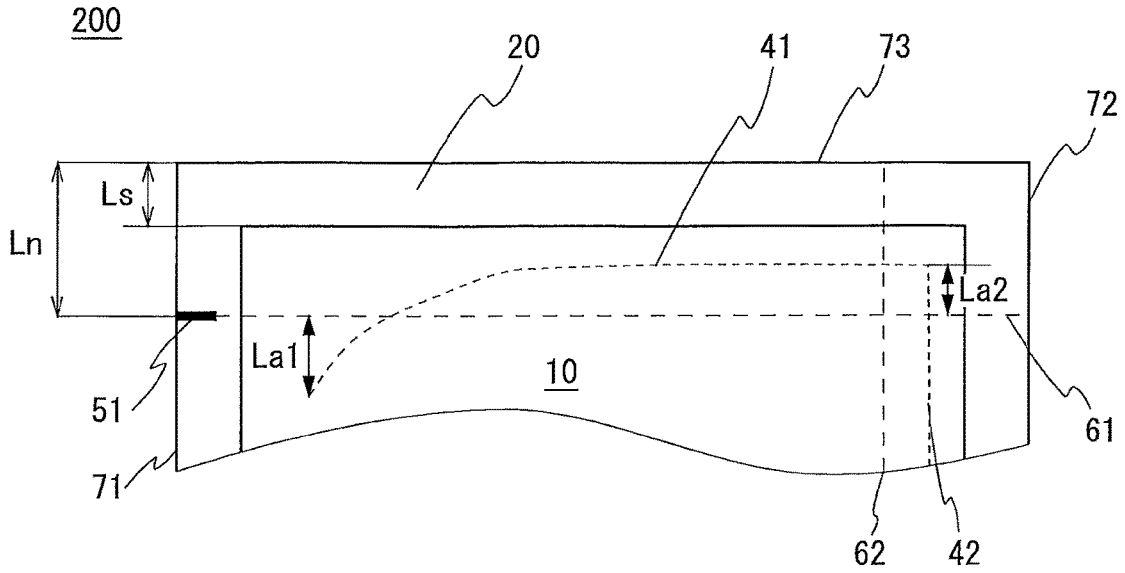
FIG. 7 is a diagram illustrating the position for forming a score line.

FIG. 7 is an enlarged view of the packaging bag 200 illustrating the position for forming a score line, taking the first score line 41 as an example. It is preferred that the first score line 41 has two ends having respective distances (La1, La2) of 1 mm or more from the first straight line 61. By forming the first score line 41 in this way, the first score line 41 can be imparted with an allowable angular range as viewed from the first notch 51. Accordingly, even when the break line is not parallel to the first straight line 61 and directed to the third or fourth edge 73 or 74, the break line can reach the first score line 41 and can be further guided toward the second edge 72.

The first and second score lines 41 and 42 can be obtained by forming intermittent linear cuts (half-cuts) in each film 10. When the film 10 is a laminated film, the first and second score lines 41 and 42 may be formed by forming cuts only through the outermost layer of the laminated film. A known method, such as a method using a Thomson blade or a razor blade, or a method using a carbon dioxide laser, may be used for forming the first and second score lines 41 and 42.

(Functions of the Score Lines)

When the first and second score lines 41 and 42 of the packaging bag 200 are formed so as to have portions respectively intersecting the first and second straight lines 61 and 62, the break line that has been started from the first notch 51 or the second notch 52, even when the direction of the break line is not parallel to the first straight line 61 or the second straight line 62, can smoothly reach the first score line 41 or the second score line 42.

The break line that has reached the first score line 41 or the second score line 42 advances along the first score line 41 or the second score line 42. The first score line 41 is formed extending toward the second edge 72. The second score line 42 is formed extending toward the third edge 73. Therefore, the break line that has reached the first score line 41 or the second score line 42 can advance to the vicinity of the second edge 72 or the third edge 73 along the first score line 41 or the second score line 42.

As described above, due to provision of the first score line 41, the packaging bag 200 can prevent the break line started from the first notch 51 from reaching the third edge 73 or the fourth edge 74 and can guide the break line to the vicinity of the second edge 72. Similarly, due to provision of the second score line 42, the packaging bag 200 can prevent the break line started from the second notch 52 from reaching the first edge 71 or the second edge 72 and can guide the break line to the vicinity of the third edge 73. Thus, the packaging bag 200 can minimize possible failure in opening which would otherwise occur due to the break line not reaching the edge which faces the first notch 51 or the second notch 52, while minimizing the occurrence of micro-cracks in the films 10. Furthermore, due to provision of the first and second score lines 41 and 42 for the first and second notches 51 and 52 respectively, openability in two directions can be improved.

The first and second score lines 41 and 42 of the packaging bag 200 are formed so as to respectively intersect the first and second straight lines 61 and 62. Thus, the first notch 51 and second notch 52 each have an allowable angular range in terms of the direction of forming the break line as viewed from the first notch 51. Accordingly, the ranges of forming the first and second notches 51 and 52 can be imparted with margins in the respective first and fourth edges 71 and 74. Therefore, compared to the conventional art in which notches have been formed so as to abut with the ends of the respective score lines, accuracy in the position of forming the notches can be alleviated.

(Modifications)

Figure 8:
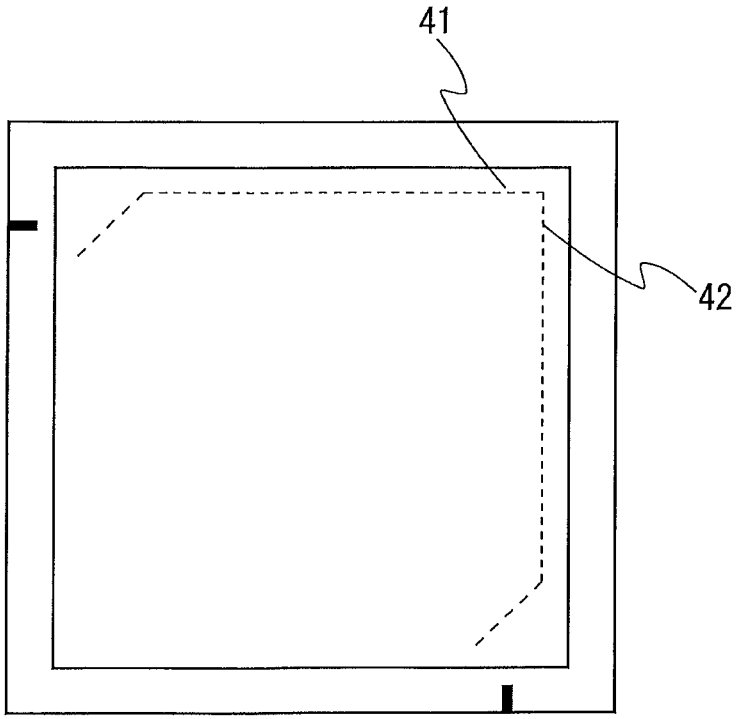
FIG. 8 is a plan view illustrating a packaging bag according to a modification of the present invention.

The first and second score lines 41 and 42 may be straight lines instead of moderate curves. FIG. 8 shows a packaging bag 201 according to a modification in which the first and second score lines 41 and 42 are formed into straight lines.

Figure 9:
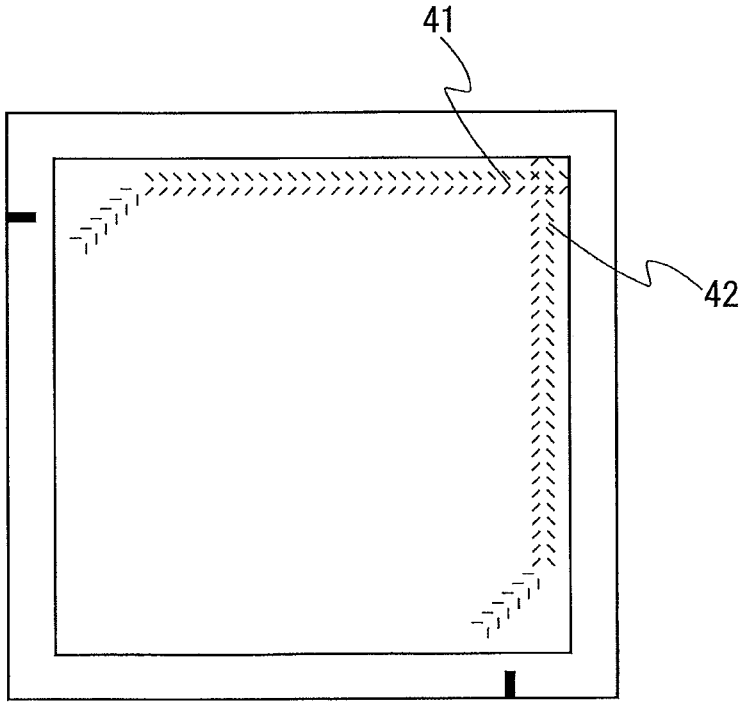
FIG. 9 is a plan view illustrating a packaging bag according to a modification of the present invention.

As long as the first and second score lines 41 and 42 can reduce the strength of the films 10 in a line, the shape of them is not limited to perforations which are structured by intermittent cuts. FIG. 9 shows a packaging bag 202 according to a modification in which the first and second score lines 41 and 42 are each formed as perforations in the shape of the kanji character for eight. Specifically, in the perforations, pairs of fine cuts, each pair forming the kanji character for eight (pairs each structured by non-parallel linear cuts facing each other), are linearly arranged. Besides these shapes, the first and second score lines 41 and 42 may each be a straight line or multiple parallel straight lines, or may have other shapes.

In the packaging bag 200, one first score line 41 and one second score line 42 are formed. However, either one of them may be formed.

Third Embodiment

Figure 10:
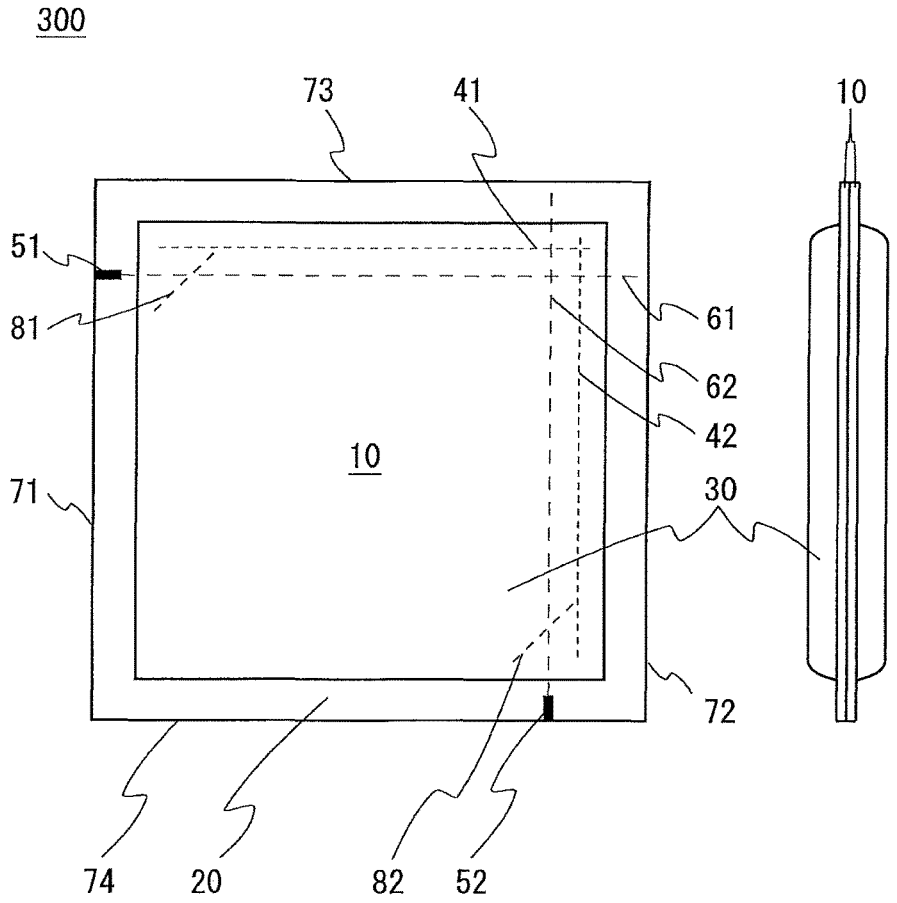
FIG. 10 is a set of diagrams, i.e., a plan view and a side view, illustrating a packaging bag according to a third embodiment of the present invention.

FIG. 10 is a set of diagrams, i.e., a plan view and a side view, illustrating a packaging bag 300 according to a third embodiment of the present invention. The packaging bag 300 is formed of two rectangular films 10 overlapped with each other, and includes a seal part 20 and a container part 30. The seal part 20 is formed by sealing four edges 71 to 74 of the films 10. The container part 30 is a portion surrounded by the seal part 20. The packaging bag 300 further includes a first score line 41 and a second score line 42, a first auxiliary score line 81 and a second auxiliary score line 82, and a first notch 51 and a second notch 52. The first and second score lines 41 and 42 are formed at least on the container part 30 to reduce the strength of the films 10. The first and second notches 51 and 52 are respectively formed on any two of the edges 71 to 74 to serve as start points for breaking the films 10 when the container part 30 is to be opened. The packaging bag 300 is different from the packaging bag 100 in the positions of forming the first and second score lines 41 and 42 and the presence or absence of the first and second auxiliary score lines 81 and 82.

(Score Lines)

The first and second score lines 41 and 42 are portions in which the strength of the films 10 is reduced in a line. The first score line 41 can prevent the break line from reaching the third edge 73 which is an edge near the first notch 51 among the edges adjacent to the first edge 71. The second score line 42 can prevent the break line from reaching the second edge 72 which is an edge near the second notch 52 among the edges adjacent to the fourth edge 74.

In the packaging bag 300, the first and second score lines 41 and 42 are formed on both of the two films 10 so that those in one film 10 respectively align with those in the other film 10 in plan view when the films 10 are formed into the packaging bag 300. However, the first and second score lines 41 and 42 may be formed on either one of the two films 10.

As shown in FIG. 10, the first and second score lines 41 and 42, and the first and second auxiliary score lines 81 and 82 are formed on the container part 30 away from the seal part 20 in plan view. The first score line 41 is formed so as to pass through an area sandwiched between a first phantom straight line 61 and the third edge 73. The phantom first straight line 61 extends from the first notch 51 to the second edge 72 in a direction perpendicular to the first edge 71. The third edge 73 is an edge near the first notch 51 among the edges adjacent to the first edge 71.

The second score line 42 is formed so as to pass through an area sandwiched between a phantom second straight line 62 and the second edge 72. The second phantom straight line 62 extends from the second notch 52 to the third edge 73 in a direction perpendicular to the fourth edge 74.

Figure 11:
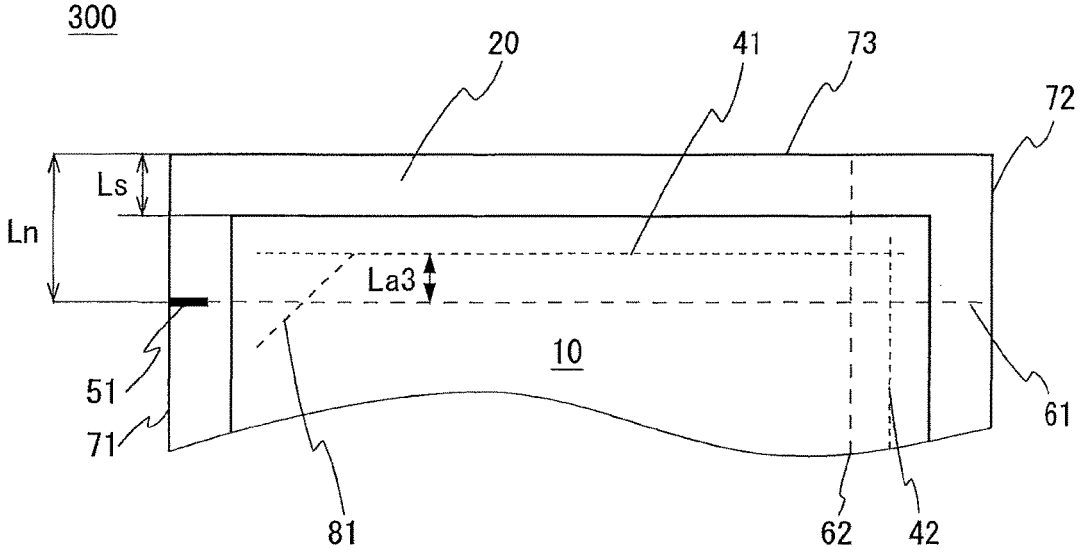
FIG. 11 is a diagram illustrating the position for forming a score line.

FIG. 11 is an enlarged view of the packaging bag 300 illustrating the position for forming a score line, taking the first score line 41 as an example. It is preferred that a minimum value (La3) of the distance between the first score line 41 and the first straight line 61 is 1 mm or more.

(Auxiliary Score Lines)

Similar to the first and second score lines 41 and 42, the first and second auxiliary score lines 81 and 82 are portions in which the strength of the films 10 is reduced in a line. The first and second auxiliary score lines 81 and 82 can prevent the break line started from the first notch 51 from reaching the fourth edge 74 and can prevent the break line started from the second notch 52 from reaching the first edge 71.

As shown in FIG. 10, the first auxiliary score line 81 is formed along a straight line intersecting the first straight line 61 and extending from an opposite side of the third edge 73 over the first notch 51 of the first edge 71 and connected to the first score line 41.

The second auxiliary score line 82 is formed along a straight line intersecting the second straight line 62 and extending from a first edge 71 side position relative to the second notch 52 of the fourth edge 74 and connected to the second score line 42.

The first and second score lines 41 and 42, and the first and second auxiliary score lines 81 and 82 can be obtained by forming intermittent linear cuts (half-cuts) in each film 10. When the film 10 is a laminated film, the first and second score lines 41 and 42, and the first and second auxiliary score lines 81 and 82 may be formed by forming cuts only through the outermost layer of the laminated film. A known method, such as a method using a Thomson blade or a razor blade, or a method using a carbon dioxide laser, may be used for forming the first and second score lines 41 and 42, and the first and second auxiliary score lines 81 and 82.

(Functions of the score lines)

Thus, provision of the first and second score lines 41 and 42 to the packaging bag 100 enables the break line that is started from the first notch 51 or the second notch 52 to reach the first score line 41 or the second score line 42 if the break line is directed to the third edge 73 or the second edge 72 instead of being directed to the facing edge. Furthermore, provision of the first and second auxiliary score lines 1 and 2 can prevent the break line started from the first notch 51 from reaching the fourth edge 74, and can prevent the break line started from the second notch 52 from reaching the first edge 71.

The break line that has reached the first score line 41 or the second score line 42 advances along the first score line 41 or the second score line 42. The first score line 41 is formed extending from the vicinity of the first edge 71 toward the second edge 72. The second score line 42 is formed extending from the vicinity of the fourth edge 74 toward the third edge 73. Therefore, the break line that has reached the first score line 41 or the second score line 42 can advance to the second edge 72 or the third edge 73, which faces the edge where the first notch 51 or the second notch 52 is formed, along the first score line 41 or the second score line 42.

As described above, due to provision of the first score line 41, the packaging bag 300 can prevent the break line started from the first notch 51 from reaching the third edge 73 and can guide the break line so as to reach the second edge 72. Similarly, due to provision of the second score line 42, the packaging bag 300 can prevent the break line started from the second notch 52 from reaching the second edge 72 and can guide the break line so as to reach the third edge 73. Thus, the packaging bag 300 can minimize failure in opening which would otherwise occur due to the break line not reaching the edge which faces the first notch 51 or the second notch, while minimizing the occurrence of microcracks in the films 10. Furthermore, due to provision of the first and second score lines 41 and 42 for the first and second notches 51 and 52 respectively, openability in two directions can be improved. In other words, the packaging bag 300 can also achieve advantageous effects similar to those of the packaging bags 100 and 200.

Since the first and second score lines 41 and 42 are formed so as to be respectively away from the first and second straight lines 61 and 62 by 1 mm or more, the break line is prevented from passing across the first score line 41 or the second score line 42 caused by momentum when breaking of the films 10 is started from the first notch 51 or the second notch 52 as a start point.

(Modifications)

Figure 12:
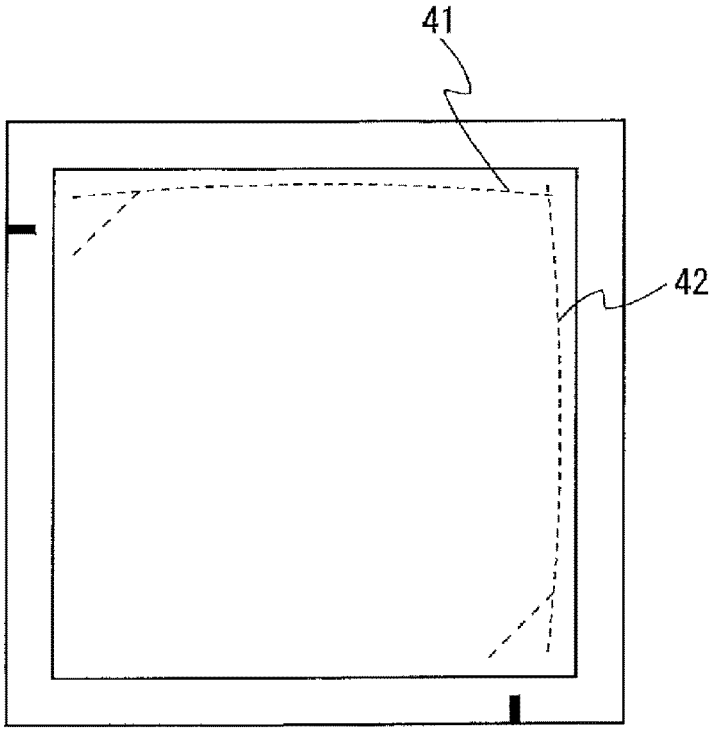
FIG. 12 is a plan view illustrating a packaging bag according to a modification of the present invention.

The first and second score lines 41 and 42 may be curves instead of straight lines. FIG. 12 shows a packaging bag 301 according to a modification in which the first and second score lines 41 and 42 are formed into curves.

Figure 13:
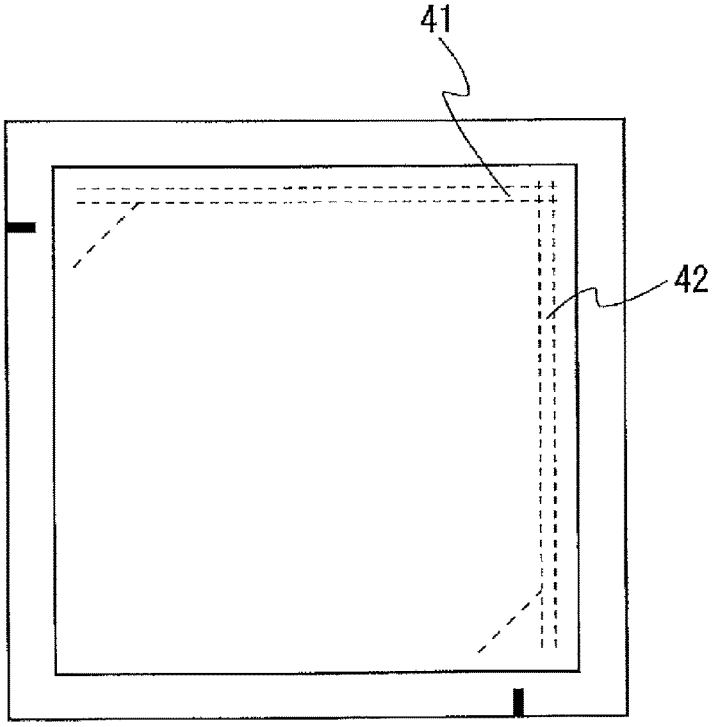
FIG. 13 is a plan view illustrating a packaging bag according to a modification of the present invention.
Figure 14:
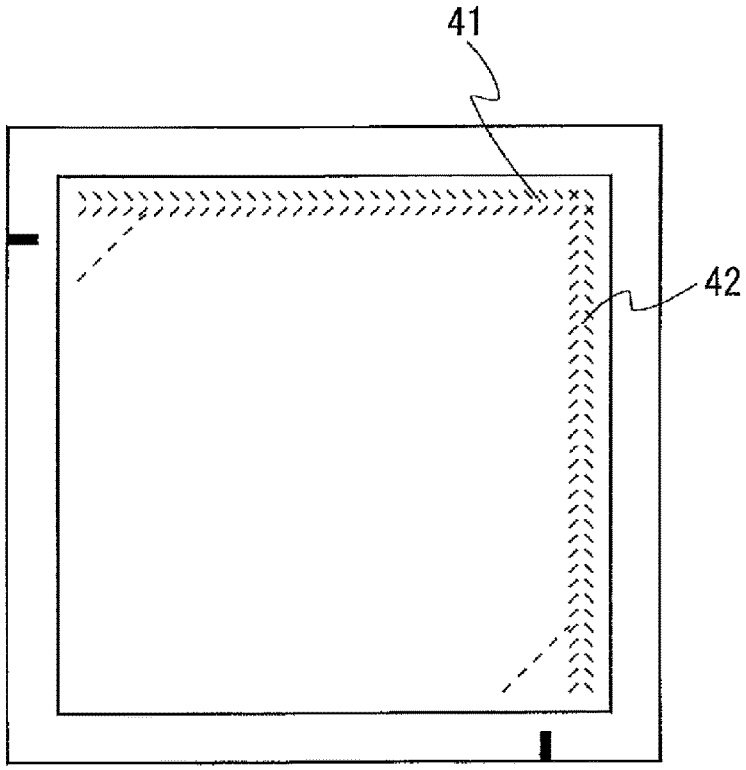
FIG. 14 is a plan view illustrating a packaging bag according to a modification of the present invention.
Figure 15:
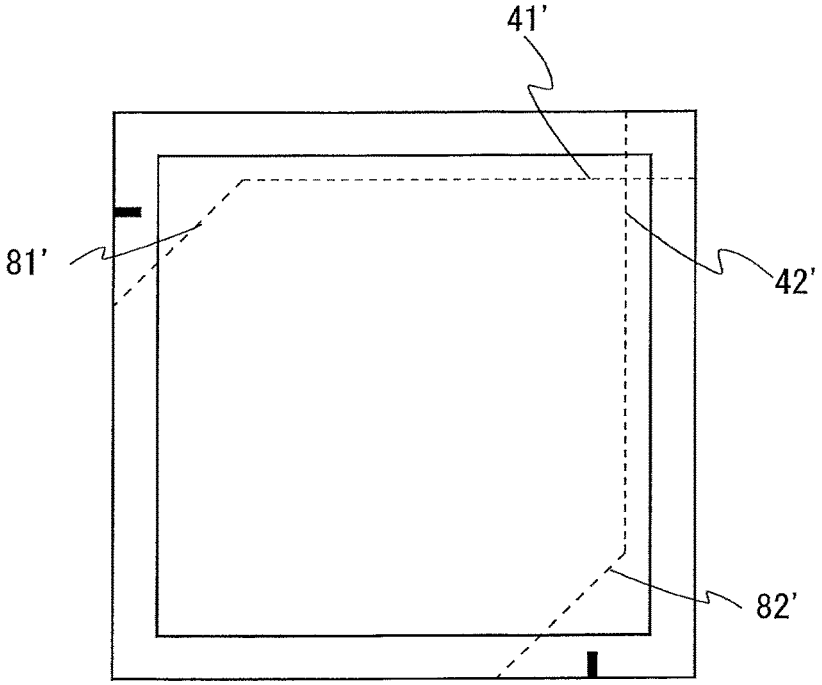
FIG. 15 is a plan view illustrating a packaging bag according to a mode in which a score line is provided on a seal part.
Figure 16:
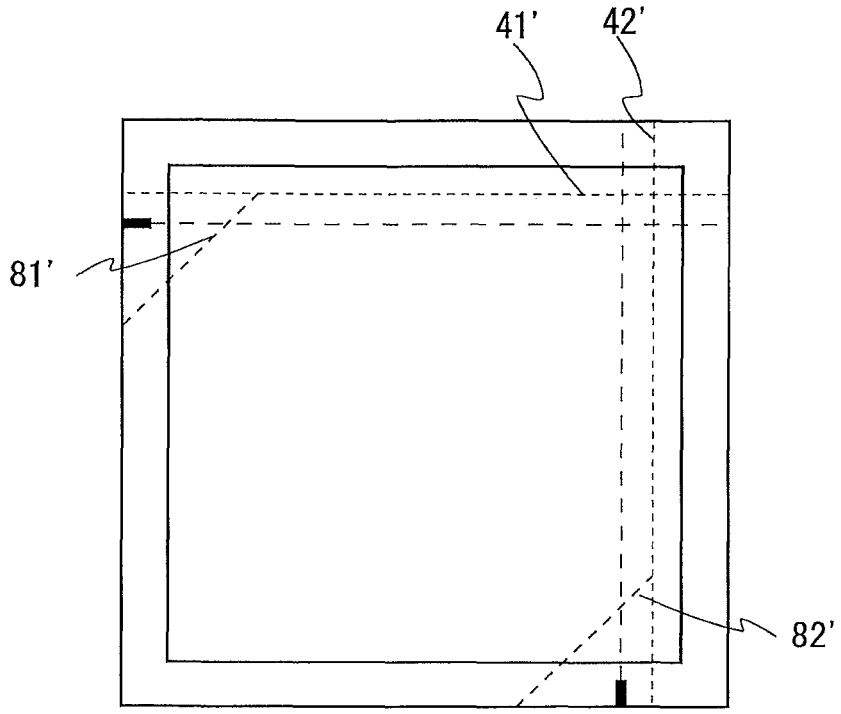
FIG. 16 is a plan view illustrating a packaging bag according to a mode in which a score line is provided on a seal part.
Figure 17:
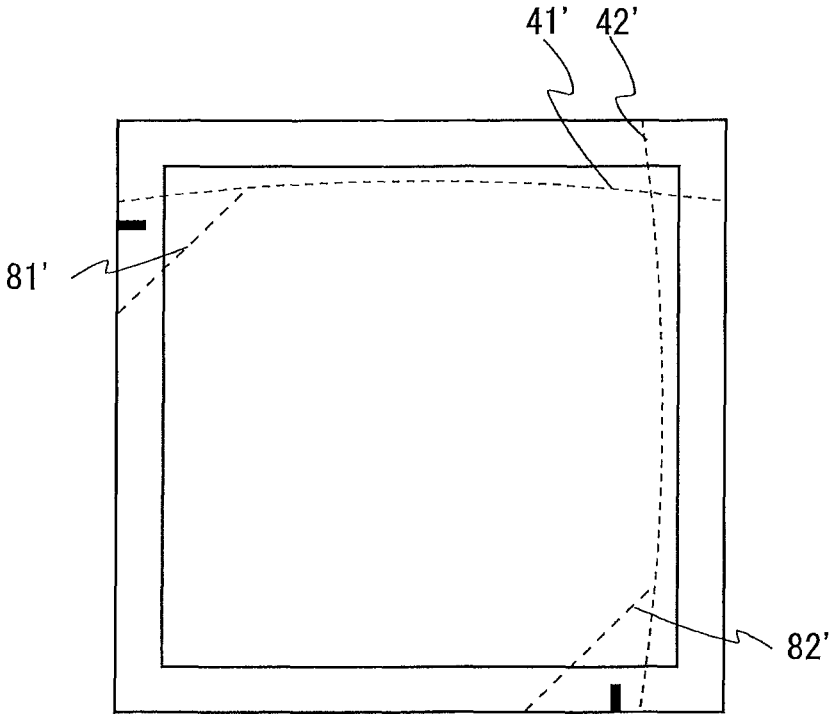
FIG. 17 is a plan view illustrating a packaging bag according to a mode in which a score line is provided on a seal part.
Figure 18:
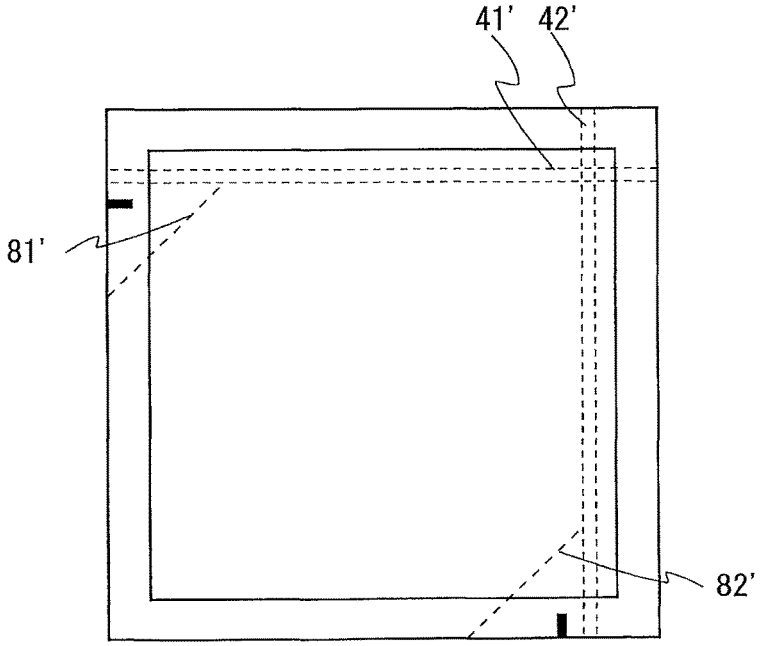
FIG. 18 is a plan view illustrating a packaging bag according to a mode in which a score line is provided on a seal part.
Figure 19:
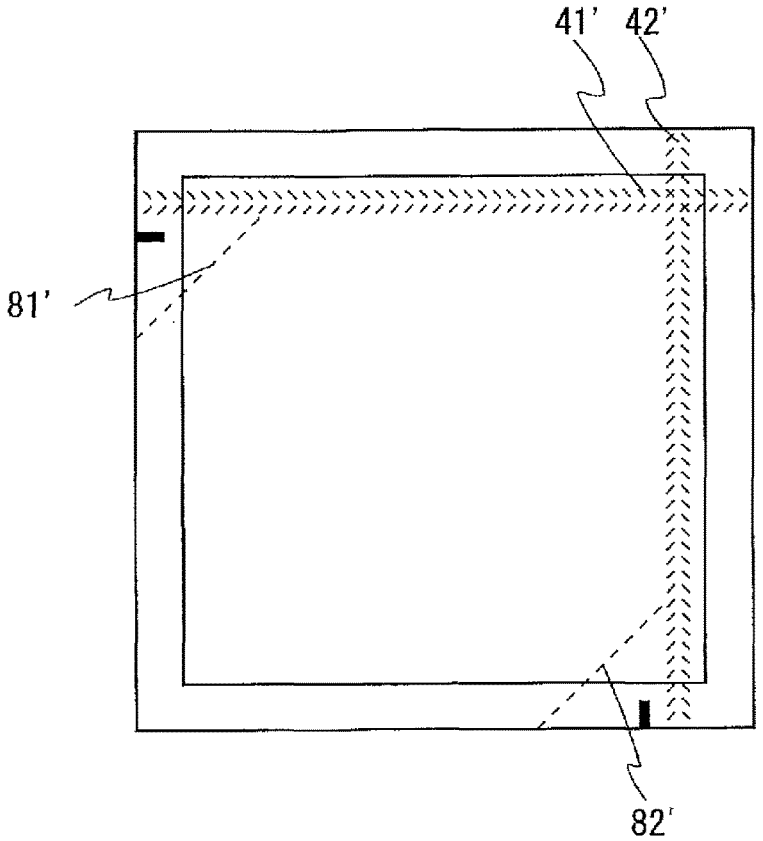
FIG. 19 is a plan view illustrating a packaging bag according to a mode in which a score line is provided on a seal part.

As long as the first and second score lines 41 and 42 can reduce the strength of the films 10 in a line, the shape of them is not limited to perforations which are structured by intermittent cuts. FIG. 13 shows a packaging bag 302 according to a modification in which the first and second score lines 41 and 42 are each formed of two parallel straight lines each of which is formed of intermittent linear half-cuts. FIG. 14 shows a packaging bag 303 according to a modification in which the first and second score lines 41 and 42 are each formed as perforations in the shape of the kanji character for eight. Specifically, in the perforations, pairs of fine cuts, each pair forming the kanji character for eight (pairs each structured by non-parallel linear cuts facing each other), are arranged in a line. Besides these shapes, the first and second score lines 41 and 42 may each be a straight line or multiple parallel straight lines, or may have other shapes.

In the packaging bag 300, one first score line 41 and one second score line 42 are formed. However, either one of them may be formed. The first and second auxiliary score lines 81 and 82 are not necessarily required.

The above description has dealt with packaging bags which are capable of preventing or reducing loss of barrier properties due to possible occurrence of microcracks. However, as shown in FIGS. 15 to 19, if packaging bags are not required to have barrier properties, a first score line 41', a second score line 42', a first auxiliary score line 81' and a second auxiliary score line 82' may be formed so as to extend onto the seal part 20. FIGS. 15 to 19 respectively show packaging bags 901 to 905 each provided with such first and second score lines 41' and 42', and first and second auxiliary score lines 81' and 82'.

EXAMPLES

Examples Related to the First Embodiment

Packaging bags for examples and comparative examples were prepared and the occurrence of microcracks in the aluminum layer of each packaging bag was examined. The packaging bags of the examples were each prepared by changing the position (distance La) and the shape of the score lines of the packaging bag 100 shown in FIG. 1. The packaging bags of the comparative examples were each formed so that the score lines of the packaging bag 100 abutted with the seal part. In all the examples and the comparative examples, two score lines (first and second score lines) were formed similarly to the packaging bag 100 so as to be symmetrical about the diagonal line drawn from the corner where the two edges respectively provided with the two notches abutted with each other.

For each of the examples and the comparative examples, packaging bags respectively using the films having the following layer structures from the outermost layer to the innermost layer were prepared.

(1) Polyethylene terephthalate (PET) (12 μm)/aluminum (AL) (7 μm)/PET having heat-sealing properties (20 μm to 50 μm)

(2) Cellophane (#300 to #500)/AL (7 μm)/PET having heat-sealing properties (20 μm to 50 μm)

(3) PET (12 μm)/AL (9 μm)/polyethylene (PE) (20 μm to 50 μm)

(4) PET (12 μm)/PE (10 μm to 30 μm)/AL (7 μm)/PE (10 μm to 40 μm)

(5) Cellophane (#300 to #500)/PE (10 μm to 30 μm)/AL (7 μm)/PE (10 μm to 40 μm)

The above films were each cut into a rectangular shape corresponding to a packaging bag dimension described later and then score lines were formed on the surfaces of the films. After that, two films, in which the score lines were formed, were overlapped with each other so that the innermost layers (sealant layers) would face each other and then contents prepared in advance were placed in the container part, followed by heat-sealing the four edges. The seal width (Ls of FIG. 2) was 5 mm. Finally, linear notches were formed in the seal part to provide a packaging bag. Each notch was formed at a position of an edge so as to have a distance (Ln of FIG. 2) of 10 mm from the corner where this edge abutted with the adjacent edge. The contents held in each packaging bag were a medical tape having a thickness of 5 mm and having a dimension smaller than that of the packaging bag by 30 mm in the lateral and longitudinal lengths.

Table 1 shows information on the packaging bags of Examples 1-1 to 1-14 and Comparative Examples 1-1 to 1-11 in terms of the dimension of the packaging bag, the distance La from each end of the first and second score lines to the inner edge of the seal part, the shape of the score lines, and evaluation (presence or absence of cracks in the aluminum layer). It should be noted that when the distance La has a positive value, the score line is away from the seal part in plan view, and when it has a negative value, the score line is formed being extended onto the seal part.

TABLE 1

| | Dimension of packaging bag | | Distance La | | | Presence or |
|---|---|---|---|---|---|---|
| | Lateral length (mm) | Longitudinal length (mm) | First (mm) | Second (mm) | Processing shape | absence of cracks |
| Example 1-1 | 110 | 95 | 5 | 5 | Straight line | Absent |
| Example 1-2 | 71 | 58 | 3 | 3 | Straight line | Absent |
| Example 1-3 | 80 | 67 | 1 | 1 | Straight line | Absent |
| Example 1-4 | 72 | 72 | 2 | 3 | Straight perforation | Absent |
| Example 1-5 | 120 | 100 | 4 | 2 | Straight perforation | Absent |
| Example 1-6 | 93 | 80 | 3 | 2 | Curve | Absent |
| Example 1-7 | 150 | 100 | 3 | 3 | Curve | Absent |
| Example 1-8 | 103 | 90 | 2 | 4 | Curved perforation | Absent |
| Example 1-9 | 80 | 80 | 2 | 2 | Curved perforation | Absent |
| Example 1-10 | 112 | 99 | 2.5 | 2.5 | Kanji character for eight | Absent |
| Example 1-11 | 90 | 130 | 2 | 3 | Kanji character for eight | Absent |
| Example 1-12 | 100 | 100 | 3 | 3 | Double line | Absent |
| Example 1-13 | 82 | 82 | 3 | 3 | Triple line | Absent |
| Example 1-14 | 95 | 110 | 5 | 5 | Quadruple line | Absent |
| Comparative Example 1-1 | 110 | 95 | 0 | 0 | Straight line | Present |
| Comparative Example 1-2 | 71 | 58 | −1 | −1 | Straight line | Present |
| Comparative Example 1-3 | 80 | 67 | −3 | −3 | Straight line | Present |
| Comparative Example 1-4 | 110 | 95 | −5 | −5 | Straight line | Present |
| Comparative Example 1-5 | 72 | 72 | −5 | −3 | Straight perforation | Present |
| Comparative Example 1-6 | 150 | 100 | −5 | −3 | Curve | Present |
| Comparative Example 1-7 | 112 | 99 | −5 | −3 | Kanji character for eight | Present |
| Comparative Example 1-8 | 103 | 90 | −5 | −4 | Curved perforation | Present |
| Comparative Example 1-9 | 100 | 100 | −5 | −5 | Double line | Present |
| Comparative Example 1-10 | 82 | 82 | −5 | −5 | Triple line | Present |
| Comparative Example 1-11 | 95 | 110 | −5 | −5 | Quadruple line | Present |

In the packaging bags of Examples 1-1 to 1-14, the first and second score lines were formed away from the inner edge of the seal part by 1 mm or more. Therefore, stress caused by sealing in the aluminum layer near the inner edge of the seal part was reduced. Thus, as shown in Table 1, microcracks occurred in none of the samples. Accordingly, it was confirmed that occurrence of microcracks in the aluminum layer near the inner edge of the seal part was prevented by forming the score lines away from the seal part. From this result, it is considered that the occurrence of microcracks can be more effectively prevented in a packaging bag using a film not including an aluminum layer.

In the packaging bags of Comparative Examples 1-1 to 1-11, the score lines were formed so as to abut with the seal part or formed being extended onto the seal part. Therefore, large stress was caused by sealing in the aluminum layer near the inner edge of the seal part. Thus, as shown in Table 1, microcracks occurred in all of the samples.

Examples Related to the Second Embodiment

Packaging bags of examples and comparative examples were prepared and openability of these packaging bags was evaluated. The packaging bags of the examples were each prepared by changing the position and the shape of the score lines of the packaging bag 200 shown in FIG. 6. In the packaging bags of the comparative examples, the score lines of the packaging bag 200 were formed so as not to intersect the phantom straight lines extending from the respective notches (Comparative Examples 2-1 to 2-9), or were respectively formed so as to be symmetrical with those of the examples about the phantom straight line (Comparative Examples 2-10 and 2-11). In all the examples and the comparative examples, two score lines were formed similarly to the packaging bag 200 so as to be symmetrical about the diagonal line drawn from the corner where the two edges respectively provided with the two notches abutted with each other (first and second score lines).

For each of the examples and the comparative examples, packaging bags respectively using the films having the following layer structures from the outermost layer to the innermost layer were prepared.

(1) Polyethylene terephthalate (PET) (12 μm)/aluminum (AL) (7/PET having heat-sealing properties (20 μm to 50 μm)

(2) Cellophane (#300 to #500)/AL (7 μm)/PET having heat-sealing properties (20 μm to 50 μm)

(3) PET (12 μm)/AL (9 μm)/polyethylene (PE) (20 μm to 50 μm)

(4) PET (12 μm)/PE (10 μm to 30 μm)/AL (7 μm)/PE (10 μm to 40 μm)

(5) Cellophane (#300 to #500)/PE (10 μm to 30 μm)/AL (7 μm)/PE (10 μm to 40 μm)

(6) PET (12 μm)/PET having heat-sealing properties (10 μm to 50 μm)

(7) Transparent deposition PET (12 μm)/PET having heat-sealing properties (10 μm to 50 μm)

(8) PET (12 μm)/PE (10 μm to 50 μm)

The above films were each cut into a rectangular shape corresponding to a packaging bag dimension described later and then score lines were formed on the surfaces of the films. After that, two films, in which the score lines were formed, were overlapped with each other so that the innermost layers (sealant layers) would face each other, followed by sealing the four edges. The seal width (Ls of FIG. 7) was 5 mm. Finally, linear notches were formed in the seal part to provide a packaging bag. Each notch was formed at a position of an edge so as to have a distance (Ln of FIG. 7) of 10 mm from the corner where this edge abutted with the adjacent edge.

The prepared packaging bags were evaluated in terms of openability when opened from the first and second notches as start points. Table 2 shows information on Examples 2-1 to 2-14 and Comparative Examples 2-1 to 2-11 in terms of the dimension of the packaging bag, the positions La1 and La2 of ends of each score line, the shape of the score lines, and evaluation (openability). It should be noted that when the positions La1 and La2 of the ends have a positive value, the score line is at a position above the first straight line 61 in FIG. 7, and when they have a negative value, the score line is at a position below the first straight line 61.

In the evaluations, if the break line reached the edge that faced the notch in all the samples, the packaging bag was taken to have sufficient openability and evaluated with a mark "++". If the break line did not reach the edge that faced the edge in which the notch was formed and failure in opening occurred in all the samples, the packaging bag was taken to have no openability and evaluated with a mark "−". If some samples were confirmed to have good openability and other samples caused failure in opening, the packaging bag was taken to have insufficient openability and was evaluated with a mark "+".

TABLE 2

| | Dimension of packaging bag | | Positions of score line ends | | | |
|---|---|---|---|---|---|---|
| | Lateral length (mm) | Longitudinal length (mm) | La1 (mm) | La2 (mm) | Shape of score line | Openability |
| Example 2-1 | 110 | 95 | −3 | 3 | Straight line | ++ |
| Example 2-2 | 71 | 58 | −2 | 2 | Straight line | ++ |
| Example 2-3 | 80 | 67 | −1 | 1 | Straight line | ++ |
| Example 2-4 | 72 | 72 | −3 | 3 | Straight perforation | ++ |
| Example 2-5 | 120 | 100 | −4 | 2 | Straight perforation | ++ |
| Example 2-6 | 93 | 80 | −3 | 2 | Curve | ++ |
| Example 2-7 | 150 | 100 | −3 | 3 | Curve | ++ |
| Example 2-8 | 103 | 90 | −2 | 4 | Curved perforation | ++ |
| Example 2-9 | 80 | 80 | −2 | 2 | Curved perforation | ++ |
| Example 2-10 | 112 | 99 | −2.5 | 2.5 | Kanji character for eight | ++ |
| Example 2-11 | 90 | 130 | −2 | 3 | Kanji character for eight | ++ |
| Example 2-12 | 100 | 100 | −3 | 3 | Double line | ++ |
| Example 2-13 | 82 | 82 | −3 | 3 | Triple line | ++ |
| Example 2-14 | 95 | 110 | −4 | 4 | Quadruple line | ++ |
| Comparative Example 2-1 | 110 | 95 | 0 | 0 | Straight line | − |
| Comparative Example 2-2 | 71 | 58 | 2 | 2 | Straight line | + |
| Comparative Example 2-3 | 80 | 67 | 1 | 0 | Straight line | − |
| Comparative Example 2-4 | 110 | 95 | −2 | −2 | Straight line | − |
| Comparative Example 2-5 | 72 | 72 | 0 | 0 | Straight perforation | − |
| Comparative example 2-6 | 150 | 100 | 0 | 0 | Curve | − |
| Comparative Example 2-7 | 112 | 99 | 0 | 0 | Kanji character for eight | − |
| Comparative Example 2-8 | 103 | 90 | 2 | 4 | Curved perforation | + |
| Comparative Example 2-9 | 100 | 100 | 0 | 0 | Double line | − |
| Comparative example 2-10 | 82 | 82 | 3 | −3 | Triple line | − |
| Comparative example 2-11 | 95 | 110 | 1 | −1 | Quadruple line | − |

In the packaging bags of Examples 2-1 to 2-14, the first and second score lines could each have an allowable angular range relative to the direction of forming the break line. Therefore, even when the direction of forming the break line was not parallel to the straight line extending from the notch to the facing edge, the break line could smoothly reach the first score line or the second score line, i.e., the break line could reach the facing edge from the notch. From this result, as shown in Table 2, it was confirmed that the packaging bags of Examples 2-1 to 2-14 had sufficient openability. It should be noted that regardless of the layer structures and thicknesses of the films, the same results were obtained.

In contrast, in some films of the packaging bags of Comparative Examples 2-1 to 2-11, the break line could not reach the facing edge from the notch, causing failure in opening. Specifically, in the packaging bags of Comparative Examples 2-1, 2-3 to 2-7 and 2-9 to 2-11, the first and second score lines could not each have an allowable angular range relative to the direction of forming the break line. Therefore, if the direction of forming the break line was not parallel to the straight line extending from the notch to the facing edge, the break line could not successfully reach the first score line or the second score line. Accordingly, the break line could not reach the facing edge from the notch, causing failure in opening. It should be noted that regardless of the layer structures and thicknesses of the films, the same results were obtained.

In Comparative Examples 2-2 and 2-8, the first and second score lines each did not have an allowable angular range relative to the direction of forming the break line. However, the break line was prevented from being directed to the edge near the notch, i.e., the edge adjacent to the edge in which the notch was formed. Thus in some samples, the occurrence of failure in opening was prevented.

Although the packaging bags related to the third embodiment are not included in Examples 2-1 to 2-14, similar results are expected to be obtained from these packaging bags.

<Examples According to the Third Embodiment, i.e., the Mode in which the Score Lines are Extended onto the Seal Part>

Packaging bags of examples and comparative examples were prepared and openability of these packaging bags was evaluated. The packaging bags of the examples were prepared by changing the positions (distance La3, see FIG. 11) and the shapes of the score lines of the packaging bags 901 to 905 shown in FIGS. 15 to 19. In the packaging bags of the comparative examples, the score lines of the packaging bags 901 to 905 were each formed so as to contact the phantom straight line extending from the notch (Comparative Examples 3-1 to 3-3 and 3-5 to 3-11), or were each formed in an area that was symmetrical with the area where the score lines of the packaging bags of the examples were formed, about the phantom straight line extending from the notch (Comparative Example 3-4).

For each of the examples and the comparative examples, packaging bags respectively using the films having the following layer structures from the outermost layer to the innermost layer were prepared.

(1) Polyethylene terephthalate (PET) (12 μm)/aluminum (AL) (7/PET having heat-sealing properties (20 μm to 50 μm)

(2) Cellophane (#300 to #500)/AL (7 μm)/PET having heat-sealing properties (20 μm to 50 μm)

(3) PET (12 μm)/AL (9 μm)/polyethylene (PE) (20 μm to 50 μm)

(4) PET (12 μm)/PE (10 μm to 30 μm)/AL (7 μm)/PE (10 μm to 40 μm)

(5) Cellophane (#300 to #500)/PE (10 μm to 30 μm)/AL (7 μm)/PE (10 μm to 40 μm)

(6) PET (12 μm)/PET having heat-sealing properties (10 μm to 50 μm)

(7) Transparent deposition PET (12 μm)/PET having heat-sealing properties (10 μm to 50 μm)

(8) PET (12 μm)/PE (10 μm to 50 μm)

The above films were each cut into a rectangular shape corresponding to a packaging bag dimension described later and then score lines were formed on the surfaces of the films. After that, two films, in which the score lines were formed, were overlapped with each other so that the innermost layers (sealant layers) would face each other, followed by sealing the four edges. The seal width (Ls of FIG. 11) was 5 mm. Finally, linear notches were formed in the seal part to provide a packaging bag. Each notch was formed at a position of an edge so as to have a distance (Ln of FIG. 11) of 10 mm from the corner where this edge abutted with the adjacent edge.

The prepared packaging bags were evaluated in terms of openability when opened from the first and second notches as start points. When opening each packaging bag, the films were each broken by applying a load in a direction of forming the break line toward the edge that was adjacent to the edge where the notch was formed, i.e., toward the edge near the notch. Table 3 shows information on the packaging bags of Examples 3-1 to 3-14 and Comparative Examples 3-1 to 3-11 in terms of the dimension of the packaging bag, the minimum value La3 of the distance from the first or second score line to the phantom straight line extending from the notch, the shape of the score lines, presence or absence of the auxiliary lines, and evaluation (openability). It should be noted that when the minimum value La3 of the distance has a positive value, the score line is at a position above the first straight line 61 in FIG. 11, and when it has a negative value, the score line is at a position below thereof.

In the evaluations, if the break line reached the edge that faced the notch in all the samples, the packaging bag was taken to have sufficient openability and evaluated with a mark "+". If the break line did not reach the edge that faced the edge in which the notch was formed and failure in opening occurred in all the samples, the packaging bag was taken to have no openability and evaluated with a mark "–".

TABLE 3

| | Dimension of packaging bag | | Distance La3 | | | | |
|---|---|---|---|---|---|---|---|
| | Lateral length (mm) | Longitudinal length (mm) | First (mm) | Second (mm) | Shape of score line | Auxiliary lines | Openability |
| Example 3-1 | 110 | 95 | 3 | 3 | Straight line | Present | + |
| Example 3-2 | 71 | 58 | 2 | 2 | Straight line | Absent | + |
| Example 3-3 | 80 | 67 | 1 | 1 | Straight line | Present | + |
| Example 3-4 | 72 | 72 | 2 | 3 | Straight perforation | Present | + |

TABLE 3-continued

| | Dimension of packaging bag | | Distance La3 | | | | |
|---|---|---|---|---|---|---|---|
| | Lateral length (mm) | Longitudinal length (mm) | First (mm) | Second (mm) | Shape of score line | Auxiliary lines | Openability |
| Example 3-5 | 120 | 100 | 4 | 2 | Straight perforation | Absent | + |
| Example 3-6 | 93 | 80 | 3 | 2 | Curve | Present | + |
| Example 3-7 | 150 | 100 | 3 | 3 | Curve | Absent | + |
| Example 3-8 | 103 | 90 | 2 | 4 | Curved perforation | Present | + |
| Example 3-9 | 80 | 80 | 2 | 2 | Curved perforation | Absent | + |
| Example 3-10 | 112 | 99 | 2.5 | 2.5 | Kanji character for eight | Present | + |
| Example 3-11 | 90 | 130 | 2 | 3 | Kanji character for eight | Absent | + |
| Example 3-12 | 100 | 100 | 3 | 3 | Double line | Present | + |
| Example 3-13 | 82 | 82 | 3 | 3 | Triple line | Absent | + |
| Example 3-14 | 95 | 110 | 4 | 4 | Quadruple line | Absent | + |
| Comparative example 3-1 | 110 | 95 | 0 | 0 | Straight line | Absent | – |
| Comparative Example 3-2 | 71 | 58 | 0 | 2 | Straight line | Absent | – (First) |
| Comparative Example 3-3 | 80 | 67 | 1 | 0 | Straight line | Absent | – (Second) |
| Comparative example 3-4 | 110 | 95 | −2 | −2 | Straight line | Absent | – |
| Comparative Example 3-5 | 72 | 72 | 0 | 0 | Straight perforation | Absent | – |
| Comparative Example 3-6 | 150 | 100 | 0 | 0 | Curve | Absent | – |
| Comparative Example 3-7 | 112 | 99 | 0 | 0 | Kanji character for eight | Absent | – |
| Comparative Example 3-8 | 103 | 90 | 0 | 4 | Curved perforation | Absent | – (First) |
| Comparative example 3-9 | 100 | 100 | 0 | 0 | Double line | Absent | – |
| Comparative Example 3-10 | 82 | 82 | 3 | 0 | Triple line | Absent | – (Second) |
| Comparative Example 3-11 | 95 | 110 | 0 | 0 | Quadruple line | Absent | – |

In the packaging bags of Examples 3-1 to 3-14, the break line was formed so as to pass through a portion of the container part sandwiched between the phantom straight line extending from the notch and the edge near the notch among the edges adjacent to the edge in which the notch was formed. Therefore, even when the break line was formed toward the edge near the notch among the edges adjacent to the edge in which the notch was formed, the break line could smoothly reach the score line and could be guided to the edge which faced the notch. Accordingly, as shown in Table 3, it was confirmed that the packaging bags of Examples 3-1 to 3-14 had sufficient openability. It should be noted that regardless of the layer structures and thicknesses of the films, the same results were obtained.

In contrast, in the packaging bags of Comparative Examples 3-1 to 3-11, the break line could not reach the facing edge from the notch, causing failure in opening, in at least either one of the first and second score lines 1 and 2. Specifically, in Comparative Examples 3-2 and 3-8, the break line deviated from the first score line formed on the straight line extending from the notch and caused failure in opening. In Comparative Examples 3-3 and 3-10 as well, the break line deviated from the sixth score line formed on the straight line extending from the notch and caused failure in opening. In other comparative examples, the break lines deviated from both the first and second score lines and caused failure in opening.

As the packaging bags of Examples 3-1 to 3-14, packaging bags, in which only either one of the first and second score lines was formed, were additionally formed to evaluate openability. The packaging bags in which only either one of the first and second score lines was formed also produced the same results as in the packaging bags of Examples 3-1 to 3-14 shown in Table 3.

INDUSTRIAL APPLICABILITY

The present invention can be suitably used for packaging sheet-shaped contents, such as a medical tape or a patch, for transdermal administration of medication, as well as for other applications.

REFERENCE SIGNS LIST

100-103, 200-203, 300-303, 901-905 Packaging bag; 10 Film; 20 Seal part; 21 Inner edge of seal part; 30 Container part; 41 First score line; 42 Second score line; 51 First notch; 52 Second notch; 61 Phantom first straight line; 62 Phantom second straight line; 71 First edge; 72 Second edge; 73 Third edge; 74 Fourth edge; 81 First auxiliary score line; 82 Second auxiliary score line.

What is claimed is:

1. A packaging bag comprising:

a first rectangular film and a second rectangular film overlapping with the first rectangular film; each of the first rectangular film and the second rectangular film includes a first edge, a second edge, which is opposite to the first edge, a third edge, which is adjacent to the first edge and the second edge, and a fourth edge, which is opposite to the third edge; the first edge, the second edge, the third edge and the fourth edge of the first rectangular film are sealed with respective edges of the second rectangular film, thereby forming a seal portion of the packaging bag, the seal part surrounds a container part of the packaging bag with an inner edge of seal part facing the container part, the seal part includes a first notch on the first edges of the first rectangular film and the second rectangular film and a second notch on the fourth edges of the first rectangular film and the second rectangular film, the container part includes a first score line, the first score line does not extend into the seal part, the first score line includes a first curve and a second curve, the first curve of the first score line starts at a first distance in a direction from the third edge to the fourth edge from a first phantom straight line extending from the first notch perpendicular to the first edge, the first line intersects the first phantom straight line, the second curve of the first score line is parallel to the third edge at a second distance from the first phantom straight line in a direction from the fourth edge to the third edge, and each of the first distance and the second distance is 1 mm or more and 5 mm or less.

2. The packaging bag of claim 1, wherein each of the first rectangular film and the second rectangular film is a multilayer film.

3. The packaging bag of claim 2, wherein each of the first rectangular film and the second rectangular film is a laminated multilayer film.

4. The packaging bag of claim 2, wherein each of the first rectangular film and the second rectangular film comprises a sealant layer, wherein the sealant layer of the first rectangular film faces the sealant layer of the second rectangular film.

5. The packaging bag of claim 4, wherein each of the first rectangular film and the second rectangular film further comprises an aluminum layer.

6. The packaging bag of claim 3, wherein the first score line and the second score line are formed only in a respective outermost layer of the first rectangular film and the second rectangular film without extending through other layers of the first rectangular film and the second rectangular film.

7. A packaging bag comprising:

a first rectangular film and a second rectangular film overlapping with the first rectangular film; each of the first rectangular film and the second rectangular film includes a first edge, a second edge, which is opposite to the first edge, a third edge, which is adjacent to the first edge and the second edge, and a fourth edge, which is opposite to the third edge; the first edge, the second edge, the third edge and the fourth edge of the first rectangular film are sealed with respective edges of the second rectangular film, thereby forming a seal portion of the packaging bag, the seal part surrounds a container part of the packaging bag with an inner edge of seal part facing the container part, the seal part includes a first notch on the first edges of the first rectangular film and the second rectangular film and a second notch on the fourth edges of the first rectangular film and the second rectangular film, the container part includes a first curved score line, which intersects a first phantom straight line extending from the first notch perpendicular to the first edges in two points and a second curved score line which intersects a second phantom straight line extending from the second notches perpendicular to the fourth edges in two points, the first curved score line intersects the second curved score line in a single point, the first score line starts at a first distance in a direction from the first edge to the second edge extending from the first notch perpendicular to the first edge, the second score lines starts at a second distance in a direction from the fourth edge to the third edge extending from the second notch perpendicular to the fourth edge and each of the first distance and the second distance is 1 mm or more.

8. The packaging bag of claim 7, wherein each of the first rectangular film and the second rectangular film is a multilayer film.

9. The packaging bag of claim 8, wherein each of the first rectangular film and the second rectangular film is a laminated multilayer film.

10. The packaging bag of claim 8, wherein each of the first rectangular film and the second rectangular film comprises a sealant layer, wherein the sealant layer of the first rectangular film faces the sealant layer of the second rectangular film.

11. The packaging bag of claim 10, wherein each of the first rectangular film and the second rectangular film further comprises an aluminum layer.

12. The packaging bag of claim 9, wherein the first score line and the second score line are formed only in a respective outermost layer of the first rectangular film and the second rectangular film without extending through other layers of the first rectangular film and the second rectangular film.

* * * * *